US005455808A

United States Patent [19]

Grupp et al.

[11] Patent Number: 5,455,808

[45] Date of Patent: Oct. 3, 1995

[54] TIMEPIECE WITH A MOBILE DISPLAY

[75] Inventors: Joachim Grupp, Neuchâtel; Yvan Terés, La Chaux-de-Fonds, both of Switzerland

[73] Assignee: Asulab S.A., Bienne, Switzerland

[21] Appl. No.: 339,272

[22] Filed: Nov. 10, 1994

[30] Foreign Application Priority Data

Nov. 26, 1993 [CH] Switzerland ..... 03534/93

[51] Int. Cl.[6] ..... G04C 19/00; G04C 17/00; G04B 19/04

[52] U.S. Cl. ..... 368/82; 368/84; 368/228; 368/242

[58] Field of Search ..... 368/82–84, 223, 368/228, 232, 239–242

[56] References Cited

U.S. PATENT DOCUMENTS

| | | | |
|---|---|---|---|
| 3,744,235 | 7/1973 | Kratomi | 58/50 R |
| 3,969,887 | 7/1976 | Fukumoto . | |
| 5,208,790 | 5/1993 | Sato | 368/15 |
| 5,228,013 | 7/1993 | Bik | 368/223 |

FOREIGN PATENT DOCUMENTS

| | | |
|---|---|---|
| 0539333 | 4/1993 | European Pat. Off. . |
| 1429688 | 3/1976 | United Kingdom . |
| 2225135 | 5/1990 | United Kingdom . |
| 8700309 | 1/1987 | WIPO . |

*Primary Examiner*—Vit W. Miska
*Attorney, Agent, or Firm*—Griffin, Butler, Whisenhunt & Kurtossy

[57] ABSTRACT

An electronic timepiece having a mobile display (2) consisting of a motif (5) composed of n discrete elements $P_j$ that can be selectively activated by a microprocessor or a logic circuit receiving at least one base time signal, and making it possible both to impose the rhythm of increase of the number of activated elements $P_j$ and to effect a random selection of said activated elements, to progressively reveal or mask the motif (5) during the passage of a period of time T and/or the approach of an event E in relation to the functions or the operation of said timepiece.

22 Claims, 4 Drawing Sheets

TIMEPIECE WITH A MOBILE DISPLAY

The instant invention relates to an electronic timepiece providing time information by means of a mobile display adapted to visualise, in a symbolic and attractive manner, the passage of given intervals of time and/or the imminence of an event in relation to one or several functions or to the operation of said timepiece.

More specifically, the invention relates to a timepiece of the above-mentioned type in which the mobile display is composed of an assembly of discrete elements forming a motif, said elements being selectively activated by means of a microprocessor or a logic circuit having management means of the mobile display and receiving at least one time and/or operation signal, said microprocessor or logic circuit making it possible both to impose the rhythm of increase or decrease of the number of activated elements and to effect at each variation a random or pseudo-random selection of the elements to be activated amongst the set of elements of the motif so as to progressively reveal or mask said motif during the passage of a given time interval, or at the proximity of a due time in relation to the functions or operation of said timepiece.

BACKGROUND OF THE INVENTION

In addition to the primary function of a timepiece, which is to indicate the current time (hours, minutes, seconds or months, years) as accurately as possible, known devices of the prior art show that efforts have been made, on the one hand to make the perception of this time information more attractive and, on the other hand, to permit visual checking of the correct operation of the timepiece, it being possible for this checking also to participate in an overall attractive effect. This has often led to the primary function of time display being complemented by an animation from which one generally also expects the production of an aesthetic effect. This animation, which is expressed in a motif, is easily perceived by the eye of the user who is immediately informed of the correct operation of his watch, of the passage of a determined time interval or of the realisation of an event specific to the functions of the timepiece itself.

In watches with an analog display, visualisation of the correct operation can, for example, be effected by placing a motif (a person, flower, sun, etc.) on the second hand or by having a figurine beat the second or also by having the seconds axle drive a disc placed under a dial provided with one or several windows giving a view of the designs carried by the disc.

U.S. Pat. No. 372,074 describes, for example, an embodiment in which a disc is divided into six sectors, each having a different figurine which appears in a window in the dial every 15 seconds.

In Swiss patent 588,109, windows distributed about the periphery of the dial reveal sequences of stars.

In Swiss patent 360,345 visualisation of the beating of the second is effected by means of a shutter placed behind the windows and solid with the axle of the escape wheel.

In digital display watches, correct operation is very commonly indicated by the flashing of an illuminated guide mark, most frequently composed of two dots located between the hour and minute numbers. This principle has, moreover, given rise to numerous variants.

Belgian patent 772,949 describes, for example, a liquid crystal display device of the pseudo analog type in which the indication of the hour is given by changing the activation of the luminous segments appearing on the dial and representing the hour and the minute hands and by flashing of a different guide mark, such as a central disc for beating the second.

In a timepiece with an analog display, visualisation of the passage of a determined time interval is effected, for example, by the cooperation between windows and discs or crowns, or only by discs or crowns solid with the minute, hour, day or month wheels. Swiss patent 665,078, for example, describes a timepiece with special aesthetic effects which makes it possible to display a design in clear and comprehensible manner only every 217 days by cooperation of two discs.

Liquid crystal display cells have also made it possible to propose solutions making it possible to visualise the passage of a given time interval or to announce the imminence of a given event. A display of this type also makes it possible to visualise at the same time the beating of the second and to produce aesthetic effects.

British patent 2,050,008 describes, for example, an electronic watch with an alphanumeric display which makes it possible to progressively reveal the activated function from its activation until its realisation (for example alarm time).

U.S. Pat. No. 4,397,595 describes, apart from a classic digital display having seven segments, a figurine, the eyes of which beat the second according to 10 different, but repetitive modes.

Similarly, British patent 2,119,994 describes two displays, the first being a conventional alphanumeric display and the second being composed of a figurine composed of different elements connected, according to six selectable modes, to the conventional display segments, and activated at the same time as those to create a repetitive animation of the figurine.

Reference being made to the above-described state of the art and, more specifically, to timepieces having at least one liquid crystal display, it will be noted that, regardless of the appeal of the visualisation effect obtained, this is always repetitive in nature, following the regular rhythm of the passage of time. In other words, after a certain time, the user will necessarily be able to predict how the animation of his watch will develop and what the final motif will be.

SUMMARY OF THE INVENTION

In contrast, the instant invention is intended to break with the monotony engendered by the repetitive and predictable nature of known animations of the prior art.

It is therefore an object of the invention to provide a timepiece making it possible to visualise in symbolic, mobile and attractive manner the passage of a given time interval, or the proximity of a due time in relation to the functions or the operation of said timepiece, this timepiece being characterised in that it has a mobile display presenting in the form of a motif composed of an assembly of discrete elements, the number of which activated at a given time being representative of the event occurring, the selection of said activated elements being, however, effected in random or pseudo random manner amongst all the available elements of the motif each time a supplementary element is activated.

The activatable elements constituting the motif can be of any kind whatsoever, but according to a preferred embodiment, in relation to which the invention will be described hereinbelow in more detail, the activatable elements are composed of the electrodes of a liquid crystal cell shaped as areas of a puzzle, the motif being composed of a design placed behind the cell, said design being progressively revealed or masked as a function of the activation of the areas of said puzzle.

According to another embodiment, the same timepiece also has a time display of the traditional analog or digital type. This second traditional display is preferably disposed on the same dial as the mobile display of the invention.

Another object of the invention is a timepiece which makes it possible to visualise several events in a symbolic, mobile and attractive manner at the same time, such as the beating of the second and the passage of time.

It is another object of the invention to provide a timepiece, the mobile display of which makes it possible to progressively reveal or mask an entire motif according to different animations at each cycle.

It is another object of the invention to provide a timepiece, the individual elements of the motif of which do not in isolation deliver any intelligible information, either graphic or alphanumeric.

For this purpose, with reference to the embodiment given by way of example in which the mobile display has a liquid crystal cell, the timepiece of the invention has a display composed of n areas ($P_1$, $P_2$, . . . ,$P_j$, . . . $P_n$) of a puzzle making it possible to visualise in symbolic, mobile and attractive manner the passage of an time interval T and/or to announce an impending event E. The time interval T can be of any kind, but it will advantageously represent a whole interval of time measurement such as a minute, hour, day, week, month, year or multiples of these time intervals. The event E is representative either of a function of the timepiece, such as the alarm hour or the due time of a predetermined duration, or of its operation, such as the end of the battery life. The time interval T is then divided into n elementary intervals t=T/n. It is possible to chose for n any whole number, preferably between 2 and 60. It is advantageous to chose a number that is a whole number divisor of T. In the case where T=1 hour, a number n of areas of the puzzle will be chosen, from, for example, the values 2,3,4, 5,6,12,15,20,30, 60 depending on whether a slow (n=2) or fast (n=60) rhythm is desired to activate each of the n areas of the puzzle.

At a moment $T_x$, located within the time interval T and corresponding to an instant at which the xth elementary interval t expires, x areas of the puzzle are activated; at the following instant $T_{x+1}$, x+1 areas of the puzzle are activated, said x+1 areas being selected in random or pseudo random manner by a microprocessor or by a logic circuit from amongst the n areas available. With the exception of the last activation phase where all n areas are activated, every time an interval t passes, the number of activated areas increases by one unit and the selection of said activated areas is modified. In the next time interval T', the selection of the areas activated at the same instant $T_x'$ will also be different from that effected at the instant $T_x$ of the time interval T which has just elapsed.

According to an embodiment of the invention, it is also possible to obtain at the same time as the visualisation of the passage of an time interval T, the mobile and attractive visualisation of the passage, or of the imminence, of other events E, related or unrelated to the time, such as an alarm time or the end of the battery life.

It is also possible to achieve the beating of the second by flashing at the rhythm of the second of all or part of the x areas activated at the instant $T_x$ or by changing, every second, the selection of the x areas activated.

According to another embodiment, a variant of this kind makes it possible, for example, to visualise at the same time the beating of the second by changing the selection of the activated areas, but also the imminence of another event E, such as an alarm time or the end of the battery life, by flashing the x areas activated at the instant $T_x$.

According to another variant of the invention, the time interval T can be composed of the sum of several intervals $T_i$. Each interval $T_i$.is then characterised by its own elementary interval $t_i$, corresponding to the activation of a number $n_i$ of areas of the puzzle, said areas being chosen amongst the n available areas. In other words, this can be expressed by the following equations:

$$T = \Sigma T_i;\ t_i = \frac{T_i}{n_i} \text{ with } \Sigma n_i = n$$

In the same way as with a single interval T the random or pseudo random selection of the $n_i$ areas of the puzzle in the time interval $T_i$ is effected by the same microprocessor or the same logic circuit.

For a given timepiece, the number n of puzzle areas is a design element which cannot be changed. In contrast, by making the appropriate modifications to the microprocessor or to the logic circuit, it is possible to obtain with the same timepiece different mobile and attractive effects by modifying either the value of T (hours, half hour, quarter hour, minute), or the values of $T_i$ and $n_i$ for the given values of T and n, these selections being effected, for example, by means of exterior command members.

It is, for example, possible with a puzzle composed of 12 areas to have a mobile and attractive display of the time, hour by hour, over 12 hours by giving T the value 12 hours, and by changing the reference by means of an exterior command member to have a visualisation of the passage of time every 5 minutes by giving T the value of 60 minutes.

According to another embodiment of the invention it is also possible to dispose on the dial of the same timepiece more than one liquid crystal display of the type already described according to the invention to obtain an overall effect, or to visualise additional information, as will be shown in greater detail in the description of the following examples.

BRIEF DESCRIPTION OF THE DRAWINGS

The invention will be better understood by study of the following description of examples in which the mobile display is composed of a liquid crystal cell, these examples being given by way of non-limiting illustration with reference to the appended drawings in which.

DESCRIPTION OF THE PREFERRED EMBODIMENTS

Example 1

Regular passage of time

This first example described with reference to FIGS. 1 to 4*d'*, corresponds to a first embodiment of a mobile display of the invention.

Figure 1:
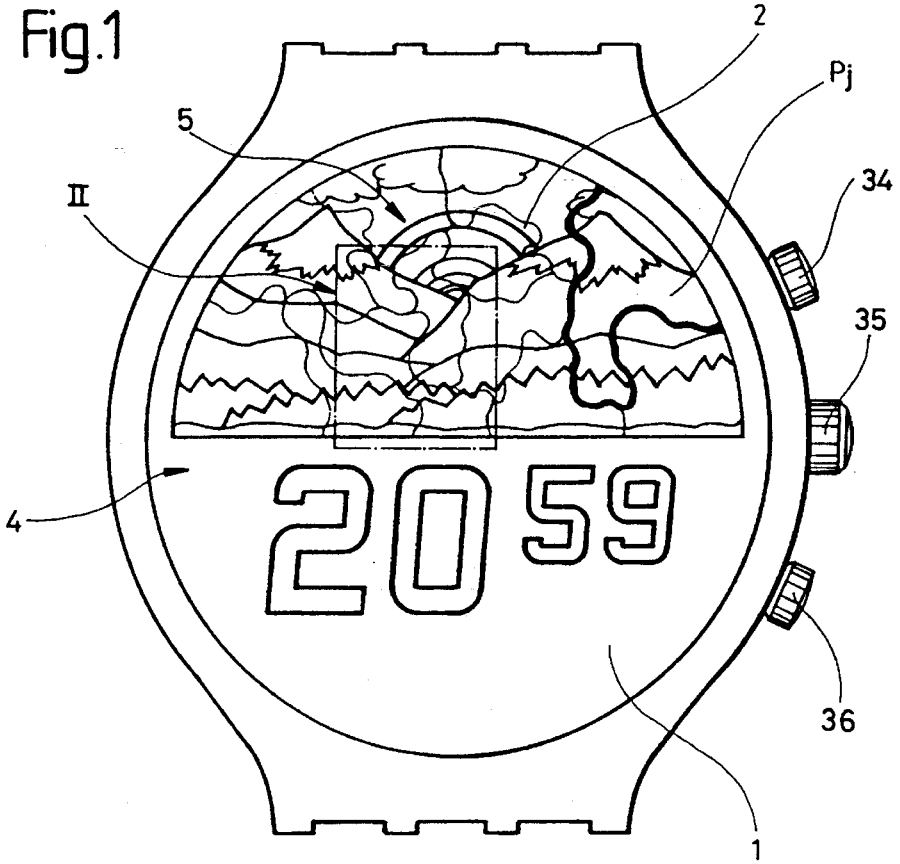
FIG. 1 shows a timepiece according to a first embodiment, this area being formed by a watch the mobile display of which is composed of a puzzle having 12 areas.

FIG. 1 shows a watch with a circular dial 4, the lower half of which is formed by a traditional time display 1 whereas the upper half has the motif 5 of a display 2 composed by the areas Pj of a mobile puzzle. By way of example, the mobile puzzle presents a 1 hour activation cycle and has 12 areas, all shown activated on FIG. 1, and thus revealing a design 3 in its entirety (see FIG. 2). In relation to the definitions given above, this example thus has the characteristics:

$$T = 60 \text{ minutes}; n = 12, t = \frac{T}{n} = 5 \text{ minutes}$$

The watch has three buttons 34, 35 and 36 situated on one side of the housing, these buttons being adapted to control the standard functions (setting of the time, adjustment of the alarm, memorisation of a predetermined duration, etc.) and for optionally changing the mode of mobile animation of the puzzle.

Figure 2:
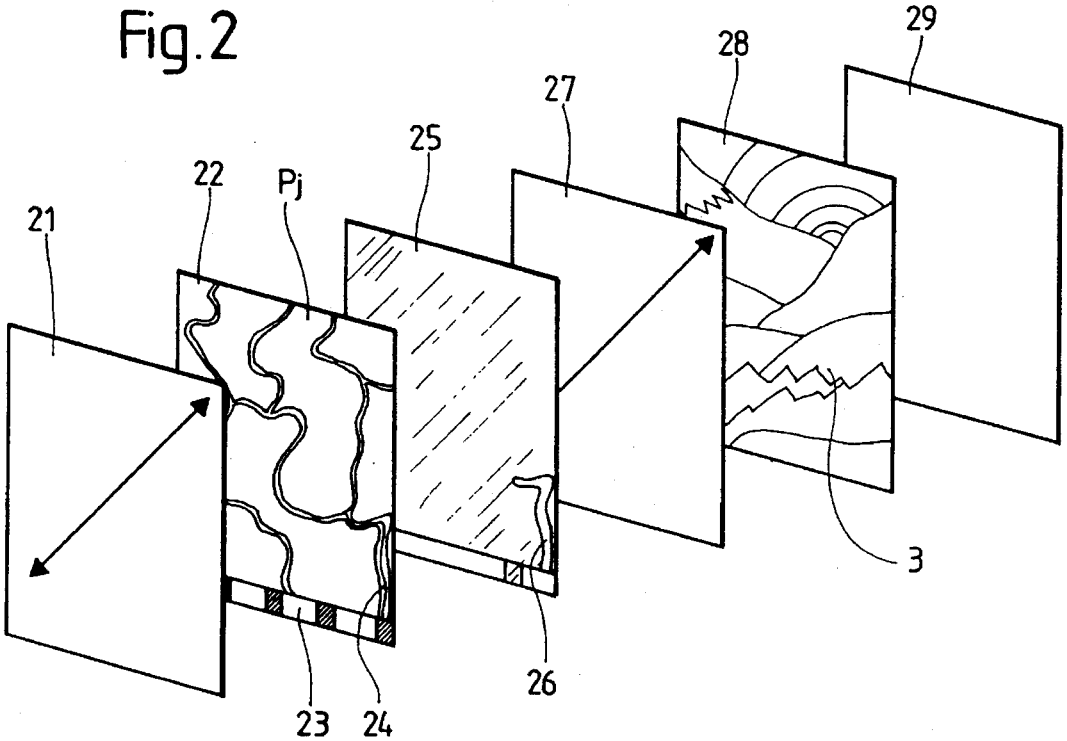
FIG. 2 shows an exploded perspective view of part of the display of FIG. 1 surrounded by the dotted and dashed line II, of FIG. 1.

FIG. 2 shows a perspective exploded view of part of the display 2 surrounded by the dotted and dashed line II of FIG. 1. By way of example a liquid crystal display device of the twisted nematic (TN) type has been shown having from its front part to its back part successively:

- a front polariser 21,
- a front glass sheet 22 having on its rear face transparent electrodes arranged on its surface to form n areas Pj of a puzzle, said areas being contiguous but electrically insulated, each being connected to a connection pin 23, either directly, or between passages 24 provided between two areas when the area to be connected is in a central position, without a common edge with the circumference of the cell,
- a rear glass plate 25 having on the side facing the plate 22 a transparent counter-electrode so arranged that the portions 26 facing the passages 24 do not have any conducting material,
- a rear polariser 27 parallel to the front polariser 21,
- a transparent plate 28 supporting the design 3, and
- a rear reflector 29.

The connection pin 23 and the counter-electrode 25 are connected to a microprocessor or to a logic circuit controlling the display 2.

When no area $P_j$ is activated, the entire cell presents a dark uniform surface and the design 3 cannot be seen.

When, on the other hand, a potential difference is applied between the counter-electrode and one of the areas $P_j$ (electrode), all the liquid crystal material located at the places where these two surfaces are superimposed switches over. This appears optically by a change in the transmission index in this display zone: the area $P_j$ thereby activated becomes clear and reveals a part of the design 3 located facing this zone on the plate 28.

It is also possible to conceive other embodiments in like manner so as to obtain the same result. It is, for example, possible to screen print the design onto the rear face of the polariser 27, or onto the front face of the rear reflector 29. If the design is opaque, the rear reflector 29 can be dispensed with.

Similarly, it follows that if the polarisers are crossed, the operation which has just been described would be inverted: without activation the cell would be transparent and would reveal the design whereas progressive activation of the areas $P_j$ would contribute to masking the design.

Similarly, without greatly changing the aesthetic appearance of the display according to the invention, but to obtain a simpler embodiment, the counter-electrode can be made without any arrangement, that is without having non-conducting portions 26. In this case, when activated, the central areas would appear connected by a fine strand to the edge of the cell. Similarly, by making the appropriate adjustments, it is possible to use different types of display cells, for example a cell termed a "Heilmeier cell".

Figure 3A:
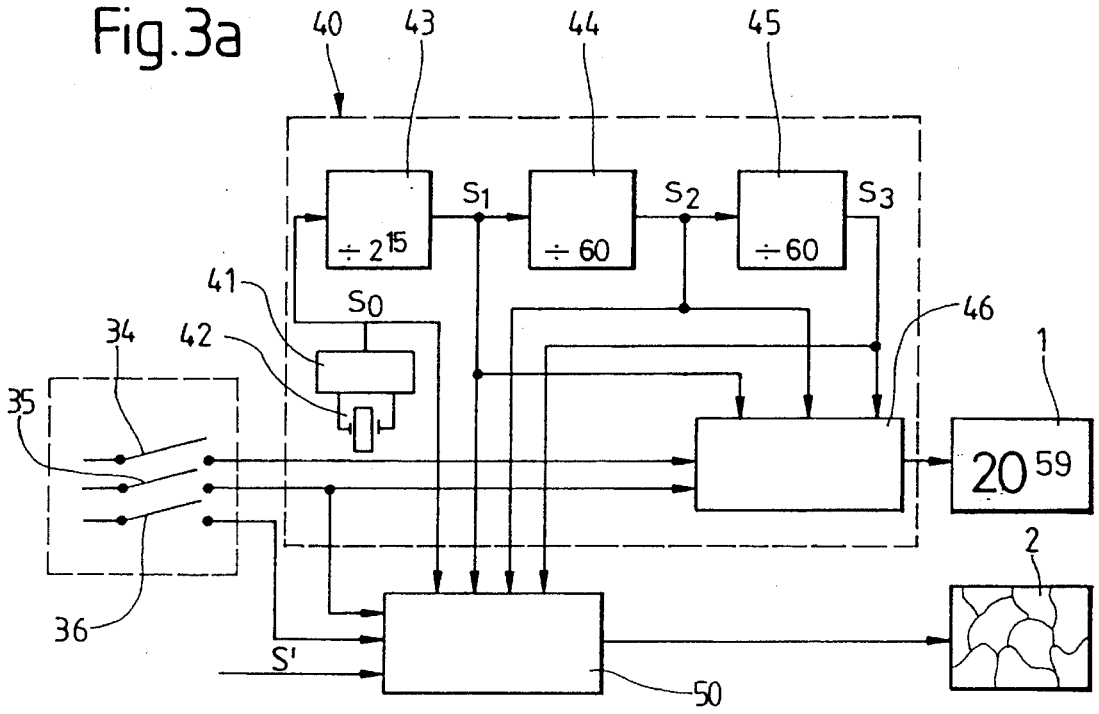
FIG. 3*a* shows a block diagram of an embodiment of the electronic circuit of the watch according to the invention.

Reference now being made to FIG. 3*a*, the circuit of a watch according to the invention has a conventional time-keeping circuit 40 associated with a traditional display means 1, of the analog or digital type, and also has a command circuit in the form of a microprocessor or a logic circuit 50 associated with the liquid crystal display 2 of the invention.

Exterior command members 34, 35, 36 make it possible to control either the time-keeping circuit 40 or the microprocessor or logic circuit 50. The command member 34 is, for example, connected to the timekeeping circuit 40 and the command member 35 to this circuit 40 and to the microprocessor or logic circuit 50 and the command member 36 is connected to the single microprocessor or logic circuit 50.

The time-keeping circuit 40 essentially has an oscillator composed of a quartz resonator 42 and a maintenance circuit 41, a division chain 43, 44, 45 and a management circuit 46 having the conventional functions associated with a traditional display. The oscillator delivers at its output a base time or reference signal $S_0$having, for example, a frequency of 32 768 Hz. A first chain of dividers 43 receives the signal $S_0$ and delivers at its output a signal $S_1$ having a frequency of 1 Hz. This signal $S_1$ is then divided by 60 by a divider 44 which supplies at its output a signal $S_2$ formed of one impulse per minute. Another divider by 60 with reference numeral 45 receives the signal $S_2$ and finally supplies at its output a signal $S_3$ composed of one impulse per hour. Other dividers could be added to the chain to have other signals having other frequencies. The signals $S_1$, $S_2$, $S_3$ are then used, on the one hand by means of the management circuit 46 designed for the traditional display 1, on the other hand by means of a microprocessor or logic circuit 50 adapted to manage the display 2 according to the invention. As can be seen, there is no direct servocontrol between the displays 1 and 2, as there is, for example, in the case of the device described in British patent 2,119,994 mentioned in the introduction.

FIG. 3*a* also shows, by way of example, a signal S' corresponding to the end of the battery life.

As may be seen in FIG. 3*a*, the management circuit 46 and the microprocessor 50 have been shown separately to make the invention easier to understand, but these two elements 46 and 50 may clearly be combined in a single microprocessor having both a management program of a traditional display and a random selection program of x items of data between n available items.

Figure 3B:
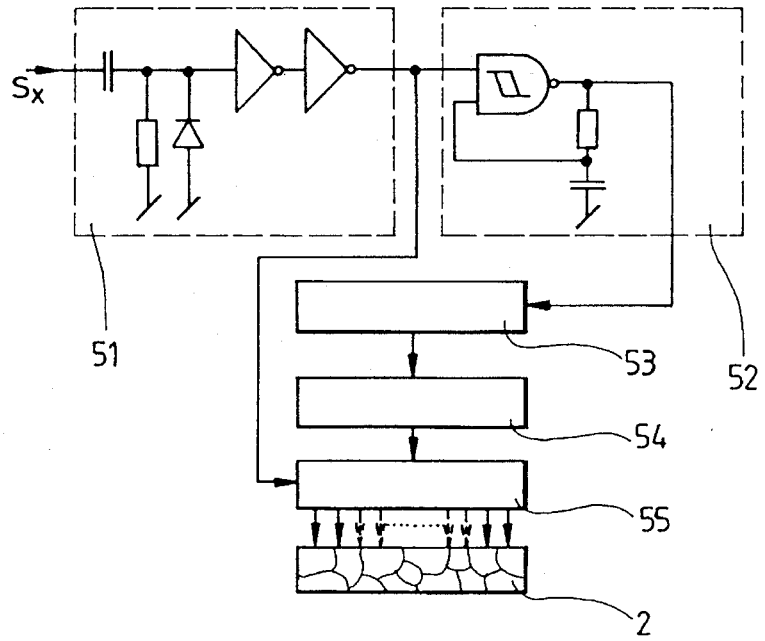
FIG. 3*b* shows an example of the logic circuit permitting random selection of x areas of n areas, FIGS. 4*a* to 4*d* and 4*a*' to 4*d*' show respectively specific phases of operation of the watch according to the invention according to various modes.

If the separate element 50 corresponds to a logic circuit it is, for example, possible to use the circuit shown in FIG. 3*b*.

A circuit of this kind has a first part 51 which generates a counting impulse CNT starting from a signal $S_x$, which may be one of the signals $S_0$, $S_1$, $S_2$ or $S_3$, or a signal extracted from the divisor 43. In the present example, the signal $S_2$ is preferably used. This impulse CNT activates an oscillator 52 which sets in motion a Johnson counter 53 with n outputs. The parts 51, 52 and 53 together constitute a random generator in which only one of n outputs of the circuit 53 is activated at one time when the impulse CNT is completed. This impulse CNT will also signal to an attack circuit 55, interposed in conventional manner before the display 2, to memorise the value obtained and to display it on the display 2, that is to activate the corresponding area $P_j$, one supplementary logic level 54, disposed between the elements 53 and 55 makes it possible to also memorise a random selection in such a way as to display more than one area at a time.

FIGS. 4*a* to 4*d* illustrate the operation of a watch according to this first example.

According to the features indicated hereinabove, the visual appearance of the mobile puzzle is modified every 5 minutes both by the activation of a supplementary area and by a new random selection of the activated areas.

Figure 4A:
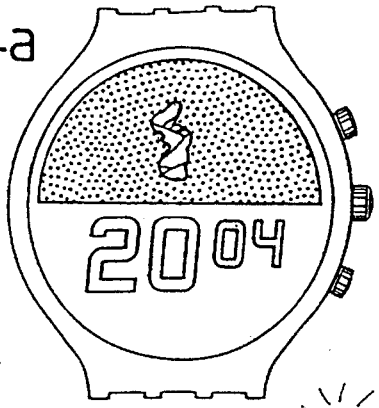
Figure 4A:
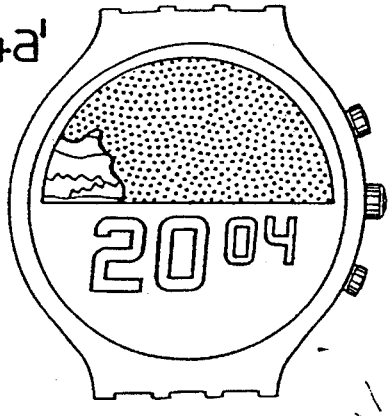

FIG. 4*a* shows the appearance of the puzzle as from the triggering of the random selection program and during the first 5 minutes (first interval of elementary time t, designated $t_1$): a single area of the puzzle is activated.

Figure 4B:
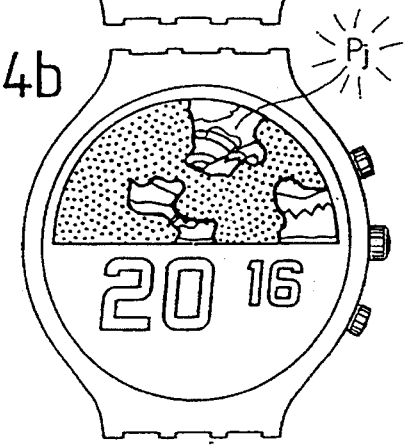
Figure 4B:
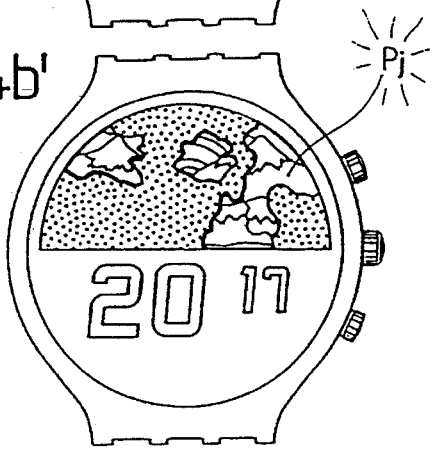

FIG. 4b shows the appearance from the 15th to the 20th minute ($t_4$): four areas are activated without one necessarily finding the three areas activated in the preceding time interval $t_3$.

Figure 4C:
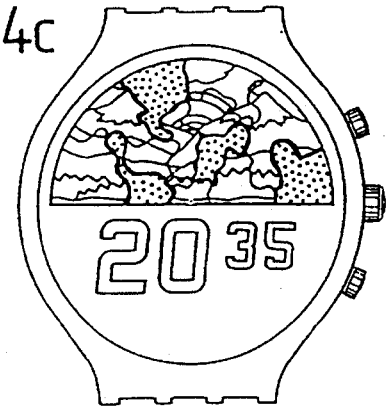
Figure 4C:
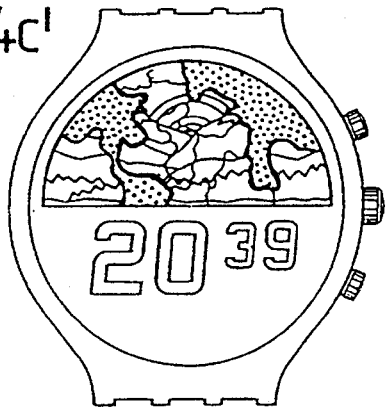

FIG. 4*c* shows the appearance from the 35th to the 40th minute ($t_8$): eight areas are activated.

Figure 4D:
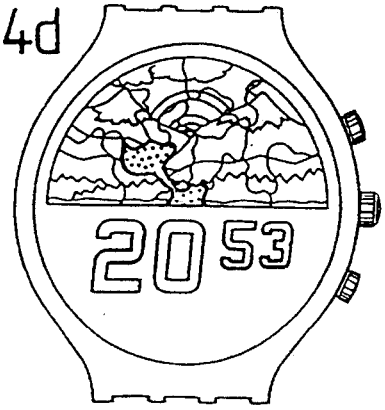
Figure 4D:
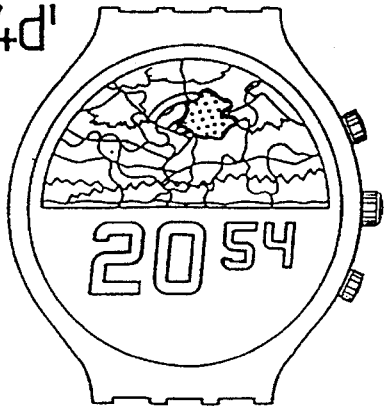

FIG. 4*d* shows the appearance of the puzzle from the 50th to the 55th minute ($t_{11}$): eleven areas are activated.

The appearance of the puzzle in the time interval $t_{12}$ (55th to 60th minute) is that shown in FIG. 1 in which all the areas are activated by then revealing the design 3 in its entirety. The same cycle will be reproduced in the following interval T', without one necessarily having for each identical elementary time interval $t_1$ to $t_{12}$ the same activated areas amongst the n areas available, as is shown by FIGS. 4*a'*, 4*b'*, 4*c'*and 4*d'*, corresponding to the elementary time intervals $t'_1$, $t'_4$, $t'_8$ and $t'_{11}$ respectively.

According to one embodiment, it is also possible to invert the mode of activation of the n areas $P_j$ of the puzzle for two successive periods T and T': in the first period T, the design is progressively revealed as has just been described, and in the second period T' it is progressively masked. This variant is, for example, illustrated by the sequence of FIGS. 4*a*, 4*b*, 4*c*, 4*d*, 4*d'*, 4*c'*, 4*b'*, 4*a'*, corresponding respectively to the elementary time intervals $t_1$, $t_4$, $t_8$, $t_{11}$, $t'_1$, $t'_4$, $t'_8$and $t'_{11}$.

In the embodiment that has just been described, the microprocessor 50 only uses the signal $S_2$ as base time signal. According to a variant, a change in the base time, which would give the time interval T a different value, for example by means of the command button 36, would make it possible to have faster, for example on 1 minute (use of the signal $S_1$) or slower animation, for example over 12 or 24 hours (use of the signal $S_3$).

Example 2

Regular passage of time beating of the second

In a watch having the general features of example 1, but where the microprocessor or the logic circuit 50 receives at least the signal $S_1$, it is possible to have at the same time a mobile display of the type described in example 1 to visualise the passage of an time interval T, and the beating of the second.

According to one embodiment, illustrated, for example, in FIGS. 4*b* or 4*b'*, this result can be obtained by flashing at the rhythm of the second of at least one area activated at this given instant.

According to another embodiment illustrated by the sequence of FIGS. 4*a* and 4*a'*—taken to represent the state of the watch at 1 second intervals—this result can be obtained by displacement, that is by changing every second the selection of the x areas activated in the time interval $t_x$.

A change from one mode to the other, for example, for two successive periods T and T' is possible either in random manner, or by the intermediary of the command button 36.

Finally, it should be noted that one variant, simultaneously implementing what has just been described in examples 1 and 2, would make it possible to have a mobile visualisation:

- of the passage of time by increasing the number of areas activated by one unit every 5 minutes
- of the "beating" of the minute by changing every minute the selection of the x areas activated in a time interval $t_x$,
- of the beating of the second by flashing at least one activated area every second.

This embodiment would correspond to the sequence illustrated by FIGS. 4*b* and 4*b'*.

Example 3

Regular passage of time and visualisation of the imminence of an alarm time and/or of the end of the life of a battery The "flashing" mode, or the "displacement" mode described in example 2 can permanently have a visual indication of the beating of the second, perhaps sporadically used for a preceding predetermined duration or according to the due time of an event E. This event is, for example, an alarm time simultaneously programmed in the management unit 46 and in the microprocessor or the logic circuit 50 by means of the command member 35. It is also possible to call up these two visual indications in the same watch to visualise two events $E_1$ and $E_2$. It is, for example, possible to use the "flashing" for the alarm time and the "displacement" for the end of the life of a battery. It is, of course, perfectly possible to associate these visual indications with conventional modes of indication such as a bell for the alarm time or a counting index for the end of the battery life.

Example 4

Regular passage of time and visualisation of fractions of time

Figure 5:
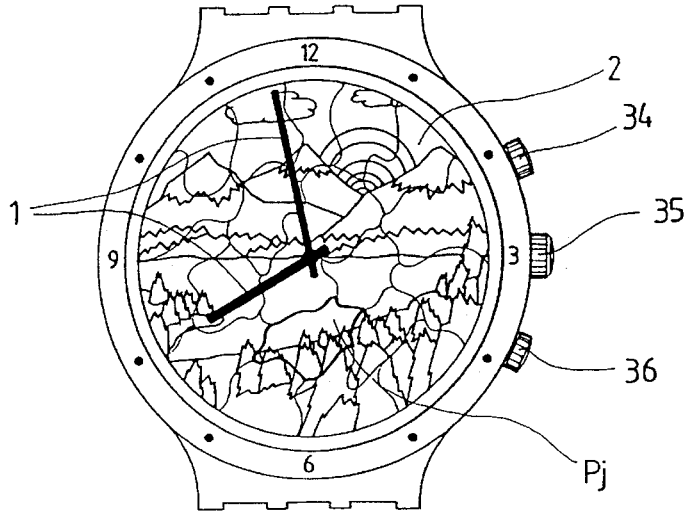
FIG. 5 shows a second embodiment of the invention having a traditional analog display of the time and a mobile puzzle of 20 areas taking up an entire circular dial.

With reference to FIG. 5, this embodiment comprises a watch having a traditional analog display by means of hands and a mobile display composed of a puzzle of 20 areas occupying the entire dial. With reference to the initial definitions, this example corresponds to the following characteristics:

$$T = 1 \text{ hour}; n = 20\ t = \frac{60}{20} = 3 \text{ minutes}$$

In this embodiment the change in the state of the mobile display is effected every three minutes. Compared to example 1, the rhythm of appearance of a new area would thus be faster, but all the possibilities and variants described or suggested in examples 1 to 3 are applicable. Moreover, it would be advantageous and attractive to visualise the passage of the large hand to the quarter hour according to an already described signalling mode, such as a brief flashing of the activated areas or of all the areas or a rapid change in the selection of the activated areas.

Example 5

Passage of time, "hour-glass" type (first mode)

The term "hour-glass type" is understood to mean visualisation of the passage of an time interval T, giving the impression of an acceleration as the due time of the period T approaches. The activation cycle of n areas of the puzzle is effected on a total period of time T, divided into several periods $T_i$ of decreasing value, each period $T_1$ corresponding to the supplementary activation of the same number of areas, which can be expressed by the equation $n_i=n_{i+1}$, in which $n_i$ represents the total number of areas activated during the period $t_i$, and $n_{i+1}$ represents the total number of areas activated during the following period $T_{i+1}$. This embodiment is described with reference to FIG. 5, the display of which is composed of a puzzle having 20 areas, presenting the following characteristics:

$$n=n_1+n_2+n_3+n_4=20$$

$$n_1=n_2=n_3=n_4=5$$

$$T=T_1+T_2+T_3+T_4=1 \text{ hour}$$

$$T_1=30 \text{ min}; T_2=15 \text{ min}; T_3=10 \text{ min}; T_4=5 \text{ min}$$

which corresponds to the elementary time intervals having respectively the value $$t_1 = \frac{T_1}{n_1} = 6 \text{ min}$$

$$t_2 = \frac{T_2}{n_2} = 3 \text{ min}$$

$$t_3 = \frac{T_3}{n_3} = 2 \text{ min}$$

$$t_4 = \frac{T_4}{n_4} = 1 \text{ min}$$

The operation of a watch according to this embodiment can easily be understood by considering that the triggering of the function described in the foregoing example 1 is reproduced for successive periods corresponding respectively to 30 min, 15 min, 10 min and 5 min, the number of supplementary areas activated being the same in each period $T_1$, $T_2$, $T_3$ or $T_4$, namely 5 areas chosen at random amongst the 20 areas available. In other words, the number of activated areas increases by one unit every 6 min during the period $T_1$, then every 3 min during the period $T_2$, then every 2 min during the period $T_3$ and finally every 1 min during the period $T_4$, thereby creating an effect of acceleration of the movement as the due time of the hour gradually arrives. It will easily be understood that this embodiment lends itself to an infinity of variants by acting, either on the programming of the microprocessor, or on the design of the cell, or on the features T, $T_i$, n and $n_i$, recalling that n (or $n_i$) does not have to be a whole number divisor of T (or $T_i$) as will, incidentally, emerge from the following example. It is also clear that the possibilities offered by the preceding examples may be applied in their entirety or in part to the present example.

Example 6

Passage of time, "hour-glass" type (second model)

According to this second embodiment, the period T is divisible into periods $T_i$ of equal value, which can be expressed by $T_i=T_{i+1}$ and $n_i$ has increasing values.

Figure 6:
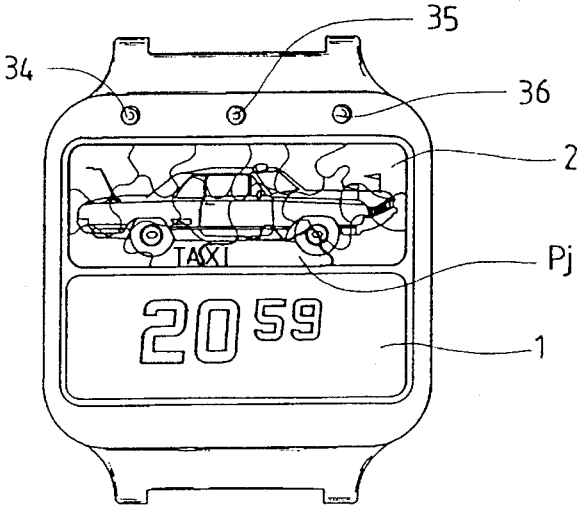
FIG. 6 shows a third embodiment in which the mobile puzzle has 16 areas, set in a rectangular dial.

With reference to FIG. 6, this embodiment comprises a watch having a traditional analog display of the time and a second rectangular mobile display composed of a 16-area puzzle having the following features:

$$T=T_1+T_2+T_3=1 \text{ hour}$$

$$T_1=T_2=T_3=20 \text{ min}$$

$$n=n_1+n_2+n_3=16$$

$$n_1=2; n_2=4; n_3=10$$

which corresponds to elementary time intervals having respectively the values $$t_1 = \frac{T_1}{n_1} = \frac{20}{2} = 10 \text{ min}$$

$$t_2 = \frac{T_2}{n_2} = \frac{20}{4} = 5 \text{ min}$$

$$t_3 = \frac{T_3}{n_3} = \frac{20}{10} = 2 \text{ min}$$

In other words, the number of activated areas increases by one unit, first every 10 minutes, then every 5 minutes and finally every 2 minutes, thereby creating an accelerating effect, In FIG. 6 which illustrates this example it will also be noted that the image of the puzzle also has a text which is not necessarily always legible except when all the areas of the puzzle are activated.

Example 7

Display by mobile puzzle having at least two separately addressable zones

In the preceding examples 5 and 6, the n areas are fictitiously distributed in a group of $n_i$ areas, but these $n_i$ areas are chosen at random amongst all the n areas of the puzzle.

In the present example, the n areas of the puzzle of the liquid crystal display are, on the contrary, divided in groups of $n_i$ isolated areas. Each group of $n_i$ areas can be separately addressed according to one or several modes described in the preceding examples, and corresponds to a time interval $T_i$ having a different value.

Figure 7:
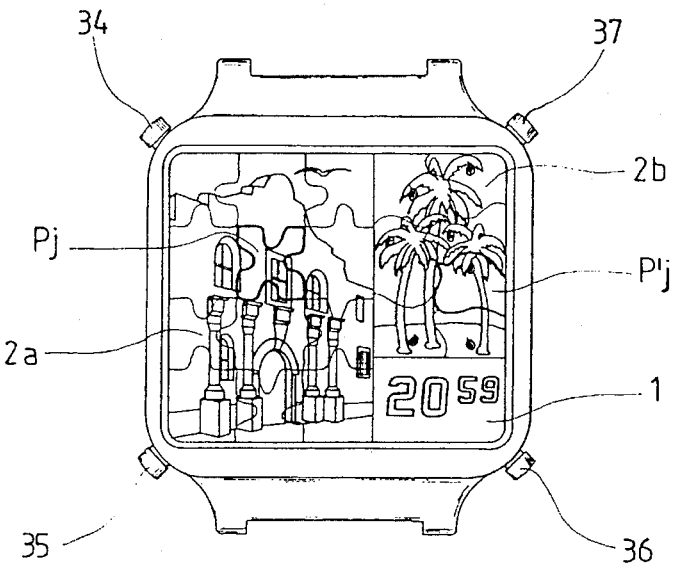
FIG. 7 shows a fourth embodiment in which the liquid crystal display screen of rectangular shape has three separately addressable zones, one being designed for a traditional time display, the two others being composed of mobile puzzles having 7 and 12 areas respectively.

By way of illustration, the FIG. 7 represents a watch, the rectangular liquid crystal dial of which has a zone 1 reserved for the traditional display of the time and a zone 2 composed of a mobile 19-area puzzle divided in two zones having respectively 12 areas of regular shape (zone 2*a*) and 7 areas of irregular shape (zone 2*b*). The display in each of these zones 2*a* and 2*b* is driven by different programs of the microprocessor, depending on one of any of the modes described in the preceding examples. The display 2a may, for example, be activated as described in example 1 by giving the time interval T, needed to activate all the areas of said display, the value $T_a$=12 hours by choosing an inverted mode of activation for two successive periods $T_a$ and $T'_a$, In relation to the definitions given at the outset, the zones 2a and 2b then have the following characteristics:

zone 2a: $T_a$=12 h; $n_a$=12 $t_a$=1 h zone 2b: $T_b$=1 week; $n_b$=7 $t_b$=1 day As shown in FIG. 7, a watch of this type may be provided with a supplementary command member 37, for example to act separately on the values desired for $T_a$ and for $T_b$.

A watch of this kind would then make it possible to visualise the passage of the day hour by hour and that of the week, day by day.

Similarly, it would be possible to replace the traditional display located in the zone 1 by a third mobile display according to the invention making it possible to visualise the passage of the fractions of hours.

The invention is, of course, not limited to the embodiments or the operations which have just been shown and described, the person skilled in the art being able to derive other modes and other embodiments from these examples without departing from the scope of the instant invention.

What is claimed is:

1. An electronic timepiece providing at least one information from the group of information consisting of the passage of a time interval T and the approach of an event E in relation to the functions or the operation of said timepiece, comprising:

a time-keeping circuit having an oscillator delivering a base time signal $S_0$, and a division chain receiving the signal $S_0$ and delivering time signals $S_1$, $S_2$, $S_3$, a dial for displaying said items of information, exterior command members delivering at least a function signal S' a mobile display, occupying at least a part of the dial and adapted to display said at least one information, said mobile display comprising an assembly of n discrete elements $P_j$ forming puzzle on a rear part of which a design is disposed, a command circuit for controlling said mobile display by selectively activating said elements $P_j$, said command circuit being responsive to at least one of a group of signals consisting of said time signals and said function signal S' for controlling the rhythm of increase or decrease of the number x of said elements $P_j$ that are activated and effecting, at each variation in the number of elements activated, a random or pseudo random selection of which of said elements amongst the n elements of said puzzle are activated, a portion of said design revealed to view being progressively varied during the passage of a time interval T, and/or the approach of an event E in relation to the functions or the operation of said timepiece.

2. A timepiece according to claim 1, wherein the discrete elements $P_j$ of the puzzle are electrodes of a liquid crystal cell.

3. A timepiece according to claim 1, wherein the time interval T is divided into n elementary equal intervals $t_i$ each corresponding to a duration at the end of which a supplementary element $P_j$ is activated.

4. A timepiece according to claim 3, wherein n is a whole number preferably between 2 and 60.

5. A timepiece according to claim 4, wherein n is a whole number divisor of T.

6. A timepiece according to claim 1, wherein T represents a whole interval of time measurement, taken from the group of intervals of time measurement consisting of a minute, an hour, a day, a week, a month, and a year, and multiples thereof.

7. A timepiece according to claim 1, wherein said command circuit comprises a microprocessor or logic circuit connected to receive said time signal $S_1$ representing the second, and driven and/or programmed so as to visualise in mobile manner on said display the beating of the second by flashing of at least one of said activated elements $P_j$, or by changing every second the selection of said activated elements during the passage of an elementary interval t.

8. A timepiece according to claim 1, wherein two successive time intervals T and T' correspond to the same mode of activation of the n elements $P_j$ to reveal or mask a design.

9. A timepiece according to claim 1, wherein two successive time intervals T and T', corresponding to inverted modes of activation of n elements $P_j$ make it possible to successively reveal a design during the interval of time T, then to mask it during the interval of time T'.

10. A timepiece according to claim 1 wherein the time interval T is composed of the sum of several intervals $T_i$, and the total number n of elements $P_j$ is the sum of the number of areas $n_i$ activated during each period $T_i$, elementary periods $t_i$ corresponding to the activation of a supplementary element being defined by $t_i=T_i/n_i$.

11. A timepiece according to claim 10, wherein $n_i= n_i+1$ and $t_i$ has decreasing values.

12. A timepiece according to claim 11, wherein n=20, $n_i$=5, $t_i$ having respectively the values 30 minutes, 15 minutes, 10 minutes and 5 minutes.

13. A timepiece according to claim 10, wherein $T_i= Ti_{+1}$ and $n_i$ has increasing values.

14. A timepiece according to claim 13, wherein T=1 hour, $T_i$=20 minutes, $n_i$ having respectively the value 2, 4 and 10.

15. A timepiece according to claim 1, wherein the mobile display comprises at least two separately addressable zones and corresponding to different characteristics $T_a$, $n_a$ and $T_b$, $n_b$.

16. A timepiece according to claim 15, wherein $T_a$= 12 hours, $n_a$=12, $T_b$=1 week and $n_b$=7.

17. A timepiece according to claim 1, which also has a management circuit to command the functions of a time display.

18. A timepiece according to claim 17, wherein the time display is located on the same dial as the mobile display.

19. A timepiece according to claim 18 wherein the dial is divided into two parts occupied respectively by said time display and by the mobile display.

20. A timepiece according to claim 18, wherein the mobile display occupies the whole dial and the time display is an analog display.

21. A timepiece according to claim 18, wherein the command circuit comprises a microprocessor or logic circuit driven and/or programmed so as also to manage the hour functions of said management circuit.

22. A timepiece according to claim 10, which further comprises at least one command member adapted to select the values of T, $T_i$ $T_a$ or $T_b$.

* * * * *